United States Patent [19]

Luthi

[11] 4,114,242

[45] Sep. 19, 1978

[54] CABLE GRIP GRIPPING APPARATUS

[75] Inventor: Kurt Luthi, Gwatt bei Thun, Switzerland

[73] Assignee: Losinger AG, Bern, Switzerland

[21] Appl. No.: 782,834

[22] Filed: Mar. 30, 1977

[30] Foreign Application Priority Data

Feb. 11, 1977 [CH] Switzerland ..... 1731/77

[51] Int. Cl.[2] ..... F16G 11/00

[52] U.S. Cl. ..... 24/115 R; 52/223 L

[58] Field of Search ..... 24/115 R, 122.6, 136 B; 403/368, 369; 52/223 R, 223 L

[56] References Cited

U.S. PATENT DOCUMENTS

| | | | |
|---|---|---|---|
| 969,195 | 9/1910 | Rothstein | 24/136 B |
| 1,655,734 | 1/1928 | McWilliams | 24/136 B |
| 3,412,511 | 11/1968 | Dietrich | 52/223 L |
| 3,778,869 | 12/1973 | Andrews | 24/122.6 |

FOREIGN PATENT DOCUMENTS

| | | | |
|---|---|---|---|
| 2,240,560 | 3/1974 | Fed. Rep. of Germany | 52/223 R |

*Primary Examiner*—Kenneth J. Dorner

*Attorney, Agent, or Firm*—Oldham, Oldham, Hudak & Weber Co.

[57] ABSTRACT

Apparatus for gripping one or more tapered segmented grips by means of which tensioning members consisting of wires or strands are anchored in an anchor block. For the purpose of detensioning the tensioned members the apparatus is installed between the anchor block and the tensioning jack. The apparatus comprises a body with a number of slotted cylindrical gripping means the number of which corresponds to the number of the tensioning members passing therethrough. The gripping means are coaxial with the tensioning members.

8 Claims, 7 Drawing Figures

CABLE GRIP GRIPPING APPARATUS

Figure 1:
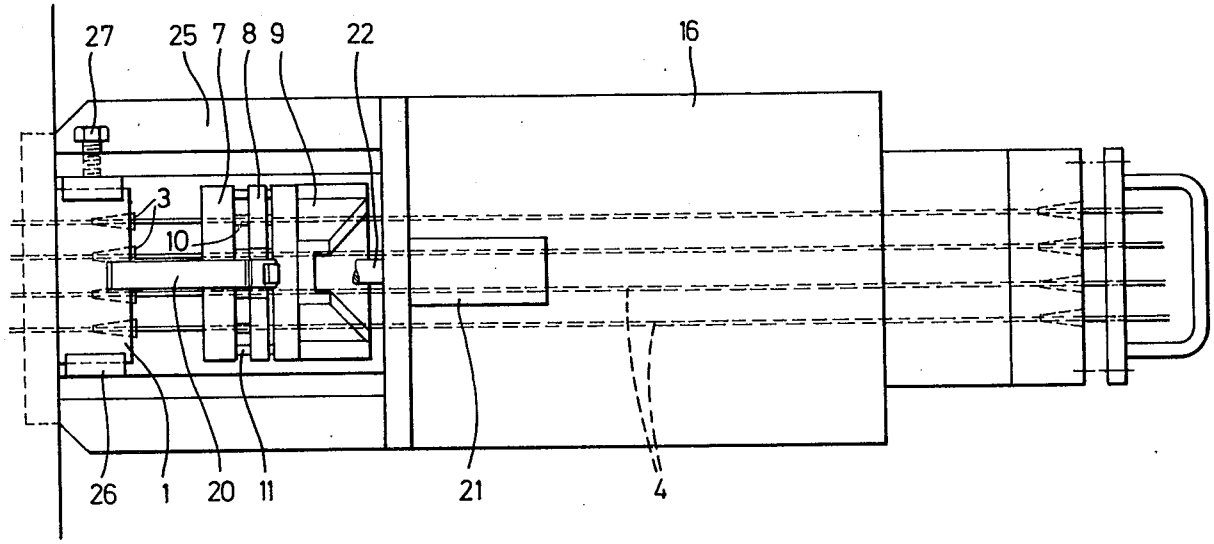

The present invention relates to an apparatus for gripping one or more tapered segmented grips seated at the ends of conical passageways through an anchor block by means of which one or more cables consisting of wires or strands are anchored under tension in said anchor block, said apparatus being disposed between said anchor block and a tensioning jack so as to be movable along said cables passing therethrough for detensioning the tensioned said cable or cables.

Apparatuses for tensioning cables by means of tapered segmented grips are known. After the cable has been tensioned to the required degree during a tensioning process and the grips have been brought in contact with the tensioning steel of an anchor head, the tensioning jack can be released.

It occurs now quite often that the anchored cables, such as bundle cables have to be partially or completely detensioned at a later date. In order to achieve such a detensioning the anchored cables have to be first overtensioned by a tensioning jack whereby the grips will be unseated from the passageways through the anchor head. However, the grips slip again back in the passageways after the tensioning jack has been released, preventing the cables from being detensioned.

In order to prevent the tapered grip, by means of which a cable to be detensioned is anchored, from being drawn again back in the conical passageway of the anchor head after it has already been at least partially unseated from the passageway of the anchor head during the overtensioning process, it is proposed in the German Provisional Pat. No. 22 40 560 to dispose a comb between the anchor head and the drawn out tapered grip. The comb is provided at its one end with a fork to be stradled on the tensioned cable. The disadvantage of such an apparatus is that a separate comb has to be used for each individual strand or wire. When the cables are arranged in a bundle, the apparatus of this art can be used only for tensioning members arranged in the outer circle of the bundle.

Means for detensioning cables anchored in an anchor head described in the U.S. Patent Specification No. 3,778,869 comprises push tubes which are inserted in the same passageways in which cables are positioned and anchored by means of gripping wedges seated at the other sides of the passageways. The push tubes which have a smaller diameter than the passageways abut against the inner ends of the wedges. By means of a push plate actuated by a threaded rod the push tubes are driven against the gripping wedges so that the wedges may be unseated from their frustoconical seats.

Such an apparatus requires push tubes and a push plate permanently inserted at the internal side of the anchor block, as well as a complicated thread mechanism.

In the German Specification No. 25 06 395 released for public inspection there is described an apparatus for tensioning and detensioning bundle cables. The apparatus comprises a body which is disposed between the anchor head and the tensioning jack. Inside the body there is positioned a hold-back plate with boreholes in which push tubes are inserted engaging in the shanks of the respective grips. Finally, there is screwed in the body a distance plate with boreholes through which pull rods pass which are screwed in the threaded boreholes of the hold-back plate.

First, the tensioning members are tensioned so that the grips which are in connection with the push tubes are unseated from the frustoconical boreholes through the anchor head and moved away from the same. The hold-back plate is held at the distance plate by pulling the pull rods; the grips will not be drawn back in the frustoconical boreholes after the bundle cables have been detensioned.

Even this apparatus is rather complicated whereby the screwing of the pull rods has to be done individually. Besides, the grips have to be in a permanent connection with the push tubes.

Accordingly, it is an object of the invention to do away with the shortcomings of the known apparatuses for tensioning and detensioning cables, such as bundle cables and to propose an apparatus for gripping one or more tapered segmented grips by means of which one or more cables are anchored under tension which enables to grip in a simple way one or simultaneously all of the grips seated in frustoconical boreholes of an anchor block and to move them away from the same, thus enabling the detensioning of one or more cables.

In accomplishing the above object the inventive apparatus comprises a body having a number of slotted cylindrical gripping means disposed in axial alignment with a respective number of said cables.

The body comprises three plates arranged in succession and connected to each other, the middle one of said plates being shiftable between two fixed outer said plates, and each of said gripping means is mounted in the outer plate nearest said tensioning jack, said projecting flanges of each of said gripping means engaging in said annular shank of a respective said grip.

Figure 2:
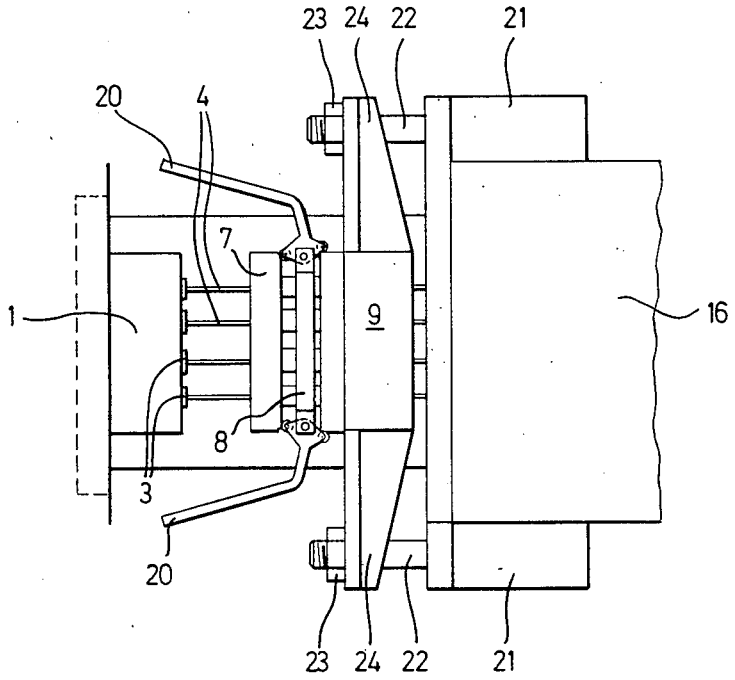
Figure 3:
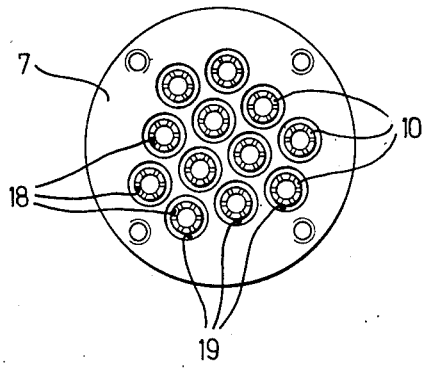
Figure 4:
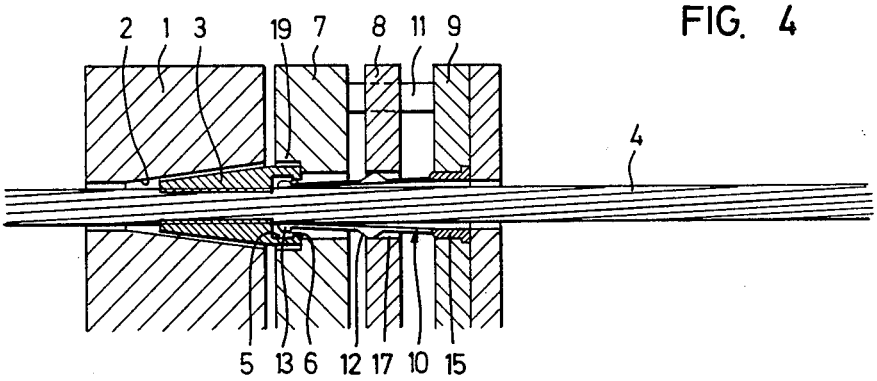
Figure 5:
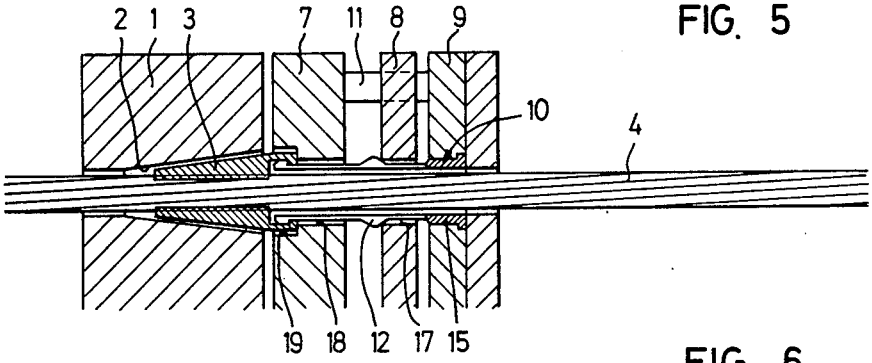
Figure 6:
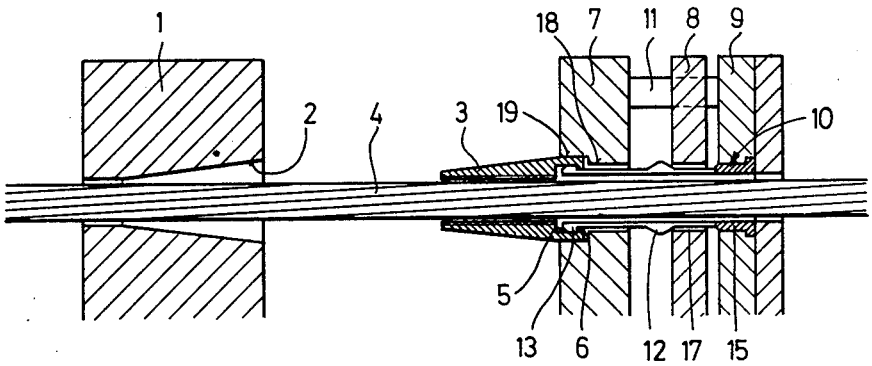
Figure 7:
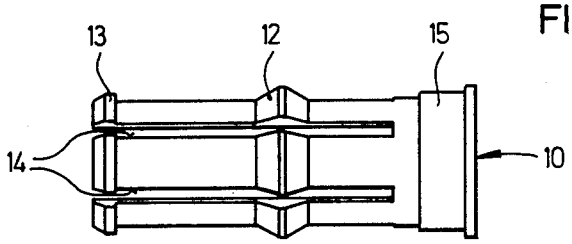

The object of the present invention will become more readily understood from the following detailed description taking into consideration the accompanying drawings in which FIG. 1 shows a schematical view of an anchor block with several tensioned bundle members and a tensioning jack and the inventive apparatus installed between the anchor block and the tensioning jack, FIG. 2 shows a schematical view of the anchor block and the inventive apparatus in enlarged scale, FIG. 3 shows a front elevation of the plate to be positioned at the anchor block with opened gripping means, FIG. 4 shows a sectional view of the inventive apparatus in the phase when the gripping means is pushed together by means of the middle plate, FIG. 5 shows a sectional view of the inventive apparatus in the phase when the gripping means is opened by shifting the middle plate, FIG. 6 shows a sectional view of the inventive apparatus in the phase when the gripped tapered grip is removed from the anchor block and FIG. 7 shows a side elevation of the opened gripping means.

Bundle members 4 consisting of wires or strands are anchored in a tensioned state in an anchor block 1 by means of tapered segmented grips 3. The anchor block 1 rests against a structure which is not shown. As it can be seen from FIGS. 1 and 2 there is disposed between the anchor block 1 and a tensioning jack 16 an apparatus for gripping the tapered grips 3 seated in the anchor block 1. This apparatus comprises a body with three plates arranged in succession and connected to each other. The fixed outer plates form a pressure plate 7 lying in the proximity of the anchor block 1 and a mounting plate 9 lying in the proximity of the tensioning jack 16. The middle plate 8 can be shifted between both the outer plates 7, 9. The shifting can be done by hand, hydraulically or pneumatically.

The mounting plate 9 is provided with two projecting arms 24 having boreholes through which piston rods 22 of two hydraulic cylinders 21 pass and are attached to the arms 24 by means of nuts 23. In this way an axial movement to and away from the anchor block 1 is imparted to the apparatus. It is also possible to move the apparatus by hand or pneumatically.

The anchor block 1 is provided with several conical passages 2 corresponding to the number of the tensioning members 4. Tapered segmented grips 3 are seated in these conical passages 2. The grips 3 consist of at least two parts forming always one grip. The tapered segmented grips 3 through which the tensioning members 4 pass are profiled in the inside in order to achieve a better clamping effect on the members 4 in the conical passages 2. Each grip 3 has at its end projecting from the anchor block 1 an undercut shank 5 forming a collar 6.

A plurality of slotted cylindrical gripping means 10 is mounted in the mounting plate 9. The pressure plate 7 and the shifting plate 8 have boreholes 18 or 17 the diameter of which is a little larger than the diameter of the gripping means 10. The number and the arrangement of the gripping means 10 in the apparatus correspond to that one of the bundle of tensioning members 4 which pass through the gripping means 10 and the tensioning jack 16. The boreholes 18 of the pressure plate 7 are enlarged outwardly at the side nearest the anchor block 1 to form cylindrical recesses 19. The boreholes 18 of the pressure plate 7 with the opened gripping means 10 are visible in FIG. 3.

The gripping means 10 according to FIG. 7 comprises a collar 15 by means of which it is mounted in the mounting plate 9, and a cylindrical body which is divided into six resilient parts by slots 14. At the central part on its circumference the body of the gripping means 10 is provided with a plurality of sections of an annular protrusion 12. The free ends of the resilient parts are provided with outwardly projecting flanges 13. The diameter of the boreholes 17 of the middle shifting plate 8 is smaller than the outside diameter of the gripping means 10 the protrusions 12. When the shifting plate 8 is shifted to align with the protrusions 12, the resilient parts with the flanges 13 are pushed together. When the shifting plate 8 is shifted back, the parts will reopen by their spring action. The gripping means 10 is made of spring steel.

Members 4 which are anchored in the anchor block 1 by means of the tapered segmented grips 3 are to be detensioned; the procedure is as follows:

The tensioning jack 16 abuts with its saddle 25 against a structure which is not shown, whereby the anchor block 1 is held by means of a clamp plate 26 and a screw 27. The bundle members 4 will be first overtensioned by the tensioning jack 16 so as to extend by approximately 5 mm. In this way the tapered segmented grips 3 will be partially unseated from the conical passageways 2; then the middle shifting plate 8 will be shifted on guide pilots 11 above the protrusions 12 of the gripping means 10 by means of handles 20 in such a way that all end parts with flanges 13 of the gripping means 10 are simultaneously closed as it can be seen in FIG. 4. The apparatus will be moved axially toward the anchor block 1 till the gripping means 10 with their flanges 13 engage in the annular shanks 5 behind the flanges 13 of the grips 3. At this moment the shifting plate 8 will be shifted again back so that it does not exert any longer pressure on the protrusions 12 of the gripping means 10; the end parts with flanges 13 will be reopened by the spring action of the material so that the collars 6 of the grips 3 are firmly hooked behind the flanges 13 of the gripping means 10. The grips 3 consisting of at least two parts are pushed from one another by the spring action of the end parts with flanges 13 which action also contributes to loosening the grips 3 from the tensioning members 4.

The grips 3 engaged by the gripping means 10 will be moved with the apparatus away from the anchor block 1 and so completely removed from the passageways 2 of the anchor block 1. Simultaneously, they are pressed against the recesses 19 and held there by the spring action of the end parts with flanges 13. This state can be seen in FIG. 6. At this moment the tensioned members 4 can be detensioned, without facing danger that the grips will be retracted into the conical passageways 2 of the anchor block 1.

By means of the above described additional apparatus the technical problem of detensioning the tensioned e.g. bundle members is solved in a simple and reliable way.

What is claimed is:

1. In an apparatus for gripping one or more tapered segmented grips seated at the ends of conical passageways through an anchor block by means of which one or more cables consisting of wires or strands are anchored under tension in said anchor block, said apparatus being disposed between said anchor block and a tensioning jack so as to be movable along said cables passing therethrough for detensioning the tensioned said cable or cables, characterized in that it comprises a number of axially split cylindrical gripping means disposed in axial alignment with the respective number of said cables, each of said gripping means being introduceable in the respective segmented grip in the anchor block to grip said segmented grip, means engaging said gripping means to move the same axially and unseat said segmented grip from its seat and to displace it axially away from said anchor block, and means for engaging and radially compressing said gripping means.

2. In an apparatus for gripping one or more tapered segmented grips as in claim 1, each of said gripping means having a projecting flange thereon for engaging in an annular shank of a respective said grip.

3. In an apparatus according to claim 1, wherein each of said gripping means has a circumferentially extending protrusion means thereon aligned with the protrusion means on the other gripping means, said engaging means engaging said protrusion means when radially compressing said gripping means.

4. In an apparatus for gripping one or more tapered segmented grips seated at the ends of conical passageways through an anchor block by means of which one or more cables consisting of wires or strands are anchored under tension in said anchor block, said apparatus being disposed between said anchor block and a tensioning jack so as to be movable along said cables passing therethrough for detensioning the tensioned said cable or cables, characterized in that it comprises a number of axially split cylindrical spring metal gripping means disposed in axial alignment with the respective number of said cables, means movable along said cables for radially compressing said gripping means; and said segmented grips and said gripping means having complementary interengageable undercut and flanged end portions thereon whereby each of said gripping means can be introduced into a respective segmented grip in the anchor block to grip and unseat said segmented grip from its seat and to displace it axially away from said anchor block by axial movement of said gripping means.

5. In an apparatus as in claim 4 including body means for moving said gripping means axially, said body means engaging said gripping means and positioned between said anchor block and said tensioning jack; said body comprising three aligned parallel plates operably connected to each other, two end plates being in fixed relative positions and said engaging means being present therebetween, said gripping means being mounted in the said end plate nearest said tensioning jack.

6. In an apparatus as in claim 5 where each of said gripping means has a circumferentially extending protrusion thereon aligned with the protrusions on the others of said gripping means.

7. An apparatus according to claim 6 wherein said middle plate and the plate nearest said anchor block have boreholes for receiving said gripping means, the diameter of said boreholes of said middle plate being smaller than the outside diameter of said gripping means including said protrusions when said gripping means is not radially compressed, said middle plate being shiftable to align with the protrusions of said gripping means to close or open simultaneously said gripping means at the ends provided with said flanged portions.

8. An apparatus according to claim 7 wherein said boreholes of said plate nearest said anchor block are enlarged outwardly to form cylindrical recesses for holding end portions of said grips as gripped by said flanged portions.

* * * * *